US008939321B2

(12) United States Patent
Larsson et al.

(10) Patent No.: US 8,939,321 B2
(45) Date of Patent: Jan. 27, 2015

(54) ELECTRONICS MODULE FOR A FUEL DISPENSING UNIT

(75) Inventors: Bengt I Larsson, Skivarp (SE); Hanna Helgesson, Malmö (SE); Kevin Burnett, Austin, TX (US); Scott Negley, Austin, TX (US); Neil Thomas, Austin, TX (US); Paul De La Port, Austin, TX (US); Annika Birkler, Malmö (SE)

(73) Assignee: Wayne Fueling Systems LLC, Austin, TX (US)

( * ) Notice: Subject to any disclaimer, the term of this patent is extended or adjusted under 35 U.S.C. 154(b) by 0 days.

(21) Appl. No.: 13/502,297

(22) PCT Filed: Oct. 16, 2009

(86) PCT No.: PCT/EP2009/063619

§ 371 (c)(1), (2), (4) Date: Apr. 16, 2012

(87) PCT Pub. No.: WO2011/044951

PCT Pub. Date: Apr. 21, 2011

(65) Prior Publication Data

US 2012/0205394 A1 Aug. 16, 2012

(51) Int. Cl.

| | |
|---|---|
| ***B67D 7/12*** | (2010.01) |
| ***B67D 7/84*** | (2010.01) |
| ***B67D 7/32*** | (2010.01) |

(52) U.S. Cl.

CPC ..... *B67D 7/84* (2013.01); *B67D 7/3236* (2013.01)

USPC ..... 222/74; 222/189.09

(58) Field of Classification Search

USPC ..... 222/74, 192, 146.6, 189.09; 361/689, 361/698, 712, 678, 690, 679.46; 141/387, 141/389–391; 454/184, 228, 234; 137/840, 137/848

See application file for complete search history.

(56) References Cited

U.S. PATENT DOCUMENTS

| | | | | |
|---|---|---|---|---|
| 5,311,928 | A * | 5/1994 | Marton | 165/80.3 |
| 5,867,403 | A * | 2/1999 | Sasnett et al. | 700/282 |
| 6,152,591 | A * | 11/2000 | McCall et al. | 700/231 |
| 6,199,579 | B1 * | 3/2001 | Taylor et al. | 137/355.22 |
| 6,512,672 | B1 * | 1/2003 | Chen | 361/695 |

(Continued)

FOREIGN PATENT DOCUMENTS

| | | | | |
|---|---|---|---|---|
| EP | 1333007 | * | 8/2003 | B67D 5/32 |
| EP | 1333007 | A1 | 8/2003 | |

(Continued)

OTHER PUBLICATIONS

Search Report and Written Opinion for corresponding International Patent Application No. PCT/EP2009/063619, dated May 20, 2010.

*Primary Examiner* — Frederick C Nicolas
*Assistant Examiner* — Bob Zadeh
(74) *Attorney, Agent, or Firm* — Mintz Levin Cohn Ferris Glovsky and Popeo, P.C.

(57) ABSTRACT

It is presented an electronics module (10) for use in a fuel dispensing unit (6*a*, 6*b*, 6*c*). The electronics module (10) comprises electronics circuitry (28) and a conductor (18) for connecting the electronic circuitry (28) to the fuel dispensing unit (6*a*, 6*b*, 6*c*). Further, the electronics module (10) has a channel means (14) extending from a first (15) to a second side (16) of the electronics module (10) defining a ventilation channel for the conductor (18) to provide venting thereof in order to reduce fuel vapors at the electronic circuitry (28).

19 Claims, 16 Drawing Sheets

(56) References Cited

U.S. PATENT DOCUMENTS

| | | | | |
|---|---|---|---|---|
| 7,031,154 | B2 * | 4/2006 | Bash et al. | 361/690 |
| 2002/0041485 | A1 * | 4/2002 | Kaneko | 361/694 |
| 2008/0239661 | A1 * | 10/2008 | McClellan et al. | 361/690 |
| 2009/0088066 | A1 * | 4/2009 | Zuzek et al. | 454/184 |
| 2011/0182036 | A1 * | 7/2011 | Huang et al. | 361/724 |

FOREIGN PATENT DOCUMENTS

| | | | | |
|---|---|---|---|---|
| EP | 1932802 | * | 6/2008 | B67D 5/64 |
| EP | 1932802 | A1 | 6/2008 | |
| EP | 2157045 | * | 2/2010 | B67D 7/84 |
| EP | 2157045 | A1 | 2/2010 | |

* cited by examiner

ELECTRONICS MODULE FOR A FUEL DISPENSING UNIT

TECHNICAL FIELD

The technical field of the present inventive concept is fuel dispensers. In more particular, the present inventive concept relates to an electronics module for a fuel dispensing unit.

TECHNICAL BACKGROUND

It is well-known that fuel, such as petrol or diesel, is a highly inflammable substance that must be handled with extreme care. An inherent property of fuel, that increases the risks of its handling, is its high volatility. For the above reasons, safety standards such as the UL standards for safety in North America and the ATEX directive have been created for fuel handling in order to reduce the thereby induced risks.

Fuel dispensing units generally comprise electronics in order for the user to be able to control the hydraulics of the fuel dispensing unit and refuel e.g. a vehicle. The electronics of the fuel dispensing unit can provide an increased risk in that for instance sparks from electronic circuitry and/or heat radiated from the electronic wiring and circuitry could ignite the fuel vapors.

With reference to FIG. 1, a prior art fuel dispensing unit 1 is shown, comprising a hydraulics compartment 2, hydraulics columns 3, nozzle arrangements 4 and an electronics box 5 arranged between the columns 3. However, there are drawbacks with this design in that e.g. circuitry of the electronics box 5 may be exposed to fuel vapors.

SUMMARY

It is with respect to the above considerations and others that the present inventive concept has been made.

In view of the above, it would therefore be desirable to achieve an improved fuel dispensing unit. In particular, it would be advantageous to achieve a fuel dispensing unit and electronics module thereof providing increased safety for users of the fuel dispensing unit.

To better address one or more of these concerns, in a first aspect of the present inventive concept it is provided an electronics module for use in a fuel dispensing unit, the electronics module comprising: electronic circuitry for controlling the fuel dispensing unit, a conductor for connecting the electronic circuitry to the fuel dispensing unit, and channel means extending from a first side to a second side of the electronics module defining a ventilation channel, the channel means comprising at least one perforation arranged to allow venting of the conductor.

Beneficially, any fuel vapors from the hydraulics, such as for instance fuel pumps, of the fuel dispensing unit that may be accompanying the conductor(s) (which is in connection with control electronics of the hydraulics) may be vented prior to the conductor reaching the electronic circuitry of the electronics module. Thereby risks of ignition of the fuel vapors may be reduced.

The at least one perforation may be a plurality of perforations in the channel means if for instance the conductor is arranged on an interior side of the channel means, i.e. the conductor not being exposed to direct airflow from the wind. In this case, the perforations may act to allow airflow to pass across the conductor and thereby boosting the dissipation of fuel vapors that can thereafter be withdrawn through the perforations. Hereto, the perforations both receive flowing air and discharge fuel vapors from the channel member.

The at least one perforation in the channel means may also be a single opening through which the conductor is led into the electronics module and the electronic circuitry therein if for instance the conductor is arranged inside the ventilation channel but exterior to the electronics module, i.e. on a side where the conductor may be subject to airflow.

Additionally, by venting the conductor(s), they may be led to the electronic circuitry at a vertical height that is below the standard 48 inches from ground level.

As indicated above, the term fuel used throughout this text is to be construed as any substance that can be used for combustion in a combustion engine, such as for instance any petroleum derived liquid mixture, ethanol or natural gas.

The second side may be opposite the first side. Thereby, air may flow through the ventilation channel and thus venting the conductor more efficiently. Hence, fuel vapors may more efficiently be removed from the vicinity of the conductor prior to the conductor reaching the electronic circuitry.

The conductor may be arranged along a horizontal direction of the channel means. Thereby airflow around the conductor may become more efficient, especially if the structure below the channel means has a ramp structure, whereby the speed of the airflow may increase notably in the horizontal plane.

The channel means may be arranged below the electronic circuitry. Thereby venting of the conductors may be provided before reaching the electronic circuitry as typically, the electronics module is arranged vertically above the hydraulics of a fuel dispensing unit.

One embodiment may comprise a structure that may be a ramp. As mentioned above, the ramp structure may provide increased speed to air flowing through the ventilation channel. Combined with the horizontal extension of the conductor, increased venting of the conductor may be provided thereby reducing fuel vapors around the conductor.

The ramp may be inclined upwardly in a direction from the first side towards a middle portion between the first side and the second side of the channel member. This arrangement allows air to flow upwardly towards an upper surface of a through opening formed by the channel means and the structure, along which upper surface the conductor may be arranged.

The ramp may be inclined downwardly from the middle portion in a direction towards the second side. This arrangement allows air to flow upwardly from the second side of the electronics module and thereby venting the conductor as described above.

The channel means may comprise at least one conductor channel. The conductor may be shielded from the hydraulics in the conductor channel by means of gaskets or foam, thereby providing additional protection of the electronic circuitry from fuel vapors.

The electronics module may define a second safety zone when arranged in a fuel dispensing unit, wherein a first safety zone of the fuel dispensing unit may comprise: a base-module comprising hydraulics; at least one nozzle module connected to the base module and adapted to hold at least one nozzle.

The electronics module may be arranged adjacent to the nozzle module. This is in contrast to the prior art solution, where conductors from the hydraulics compartment are relayed through the columns that also comprise hydraulics to the electronics box, thereby increasing the risk of ignition of fuel vapors.

The above aspect and others of the inventive concept will be apparent from and elucidated with reference to the embodiments described hereinafter.

BRIEF DESCRIPTION OF THE DRAWINGS

Various aspects of the present inventive concept will now be described in more detail, with reference to the appended drawings, of which.

DETAILED DESCRIPTION

Figure 1:
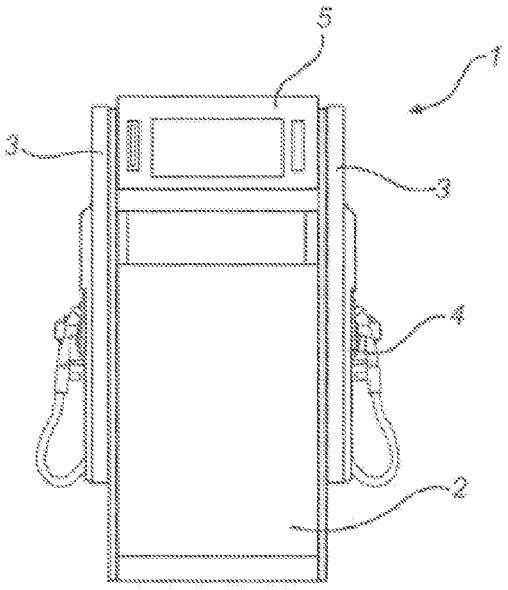
Fig. 1 (PRIOR ART)
FIG. 1 shows a prior art fuel dispensing unit.
Figure 2A:
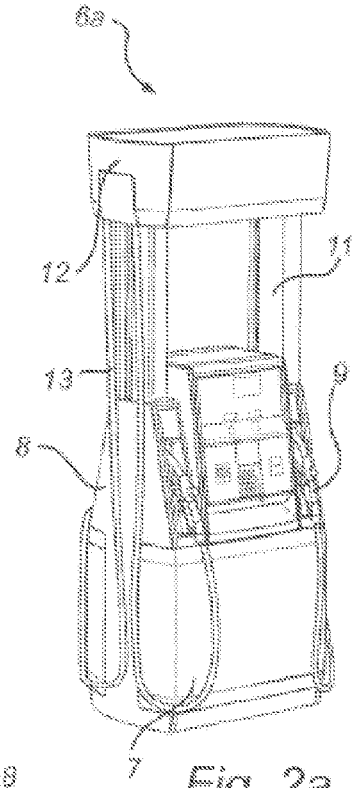
FIGS. 2*a-c* show various fuel dispensing units having an electronics module according to one embodiment of the present inventive concept.

With reference to FIG. 2*a*, a fuel dispensing unit 6*a* according to an embodiment of the present inventive concept is shown. The fuel dispensing unit 6*a* comprises inter alia a base module 7 containing hydraulics 38 (see FIG. 5*a*), nozzle modules 8 on top of the base module 7 for holding nozzles 9, each of which can be lifted from its respective nozzle module 8 for loading fuel e.g. to a vehicle. On top of the nozzle modules 8, columns 11 are arranged. Each column 11 comprises a tube arrangement (not shown) for transportation of fuel to the nozzles 9. A top module 12 is supported by the columns 11. The tube arrangement is connected to hoses 13, connecting the nozzles 9 to the hydraulics 38. The above components 7, 8, 9 and 11 form a first safety zone Z1 of the fuel dispensing unit 6. On top of the base module 7 is an electronics module 10 arranged forming a second safety zone Z2. The electronics module 10 is coupled to electronics (not shown) in the base module 7. The electronics module 10 can thereby control the hydraulics of the base module 7 allowing fuel to be dispensed via the nozzles 9.

The safety zones Z1 and Z2 are herein defined as Z1 being less safe than the second safety zone Z2 with respect to the concentration of fuel vapor, which is to be construed as fuel vapors being present to a greater degree in the first safety zone Z1 compared to the second safety zone Z2. Thus, in the first safety zone Z1, an explosive atmosphere may be present whereas in safety zone Z1 an explosive atmosphere is generally not allowed under normal operation.

Figure 2B:
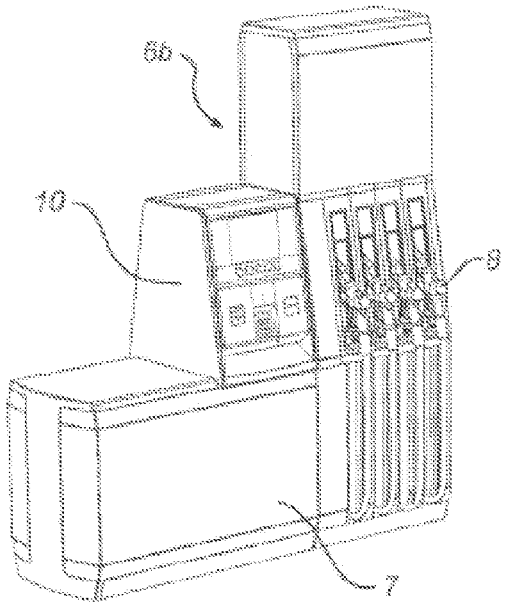

In FIG. 2*b*, a variation of the fuel dispensing unit 6*a* of FIG. 2*a* is shown. In this variation, the base module 7 of fuel dispensing unit 6*b* is provided beside the nozzle modules 8 and the electronics module 10 is arranged on top of the base module 7.

Figure 2C:
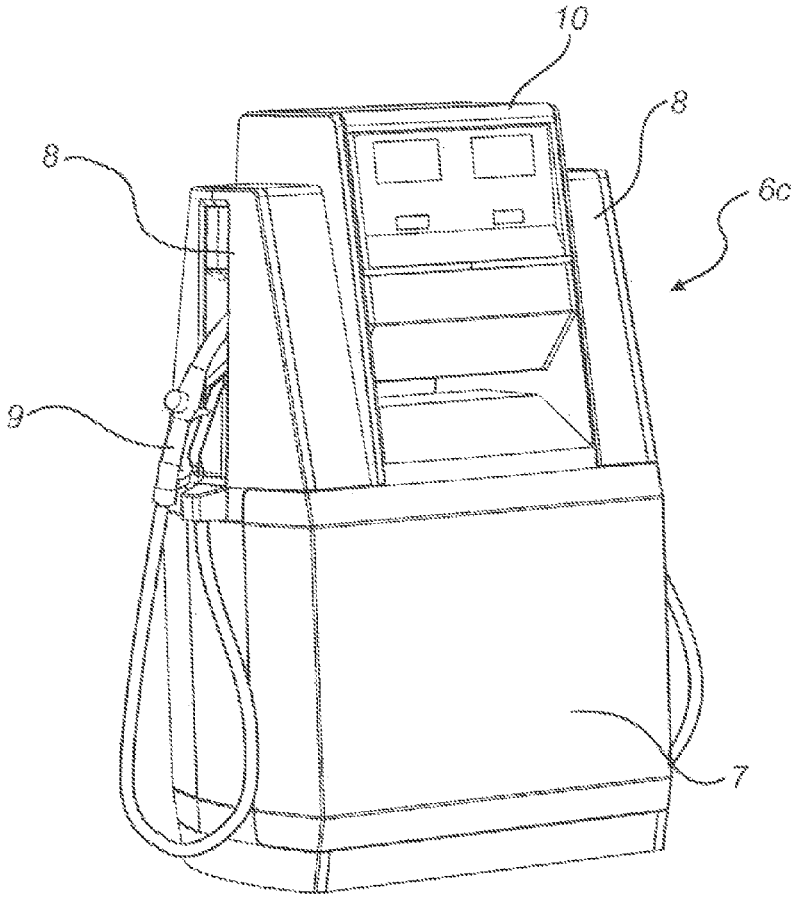

A simpler variation of the fuel dispensing unit 6*a* is shown in FIG. 2*c*. In fuel dispensing unit 6*c*, the electronics module 10 is arranged on top of base module 7 with the electronics module 10 being arranged between the nozzle modules 8 and nozzles 9.

In all of the variations 6*a-c* shown in FIGS. 2*a-c*, fuel dispensing units 6*a-c* are assembled from modular components 7, 8, 10, 11 and 12, of which at least the exterior design of electronics module 10 is essentially the same in all of the above cases. The electronics module 10 can thus be seen as a separate entity (separated from e.g. the nozzle modules 8) in which generally all electronic coupling may be connected directly to the base module 7. Conductors 18, such as cables (see e.g. FIG. 3*a*) in the electronics module 10 coupled to the base module 7 for controlling the hydraulics can thereby be arranged physically separated from the hydraulics. In addition, by connecting the electronics module 10 directly to the base module 7, the transition from the first safety zone Z1 to the second safety zone Z2 may be provided at a lower vertical level than the prescribed 48 inches. To this end, the volume in which conductors are within the first safety zone Z1 is reduced.

Beneficially, fuel vapors accompanied with the conductor 18 when passing from the base module 7 to the electronics module 10 can be vented before reaching any electronic circuitry within the electronics module 10. Thus, the risk of fuel infused explosions is reduced.

Variations of the electronics module 10 may of course occur in that e.g. the user interface can be adapted to the requirements of the specific type of fuel dispensing unit 6*a-c*. For instance, the electronics module 10 may comprise a transaction module enabling customers to pay at the fuel dispensing unit 6*a-b* or being of a simpler design without a transaction module 10 in case customers are to pay at a counter of the gas station.

Figure 3A:
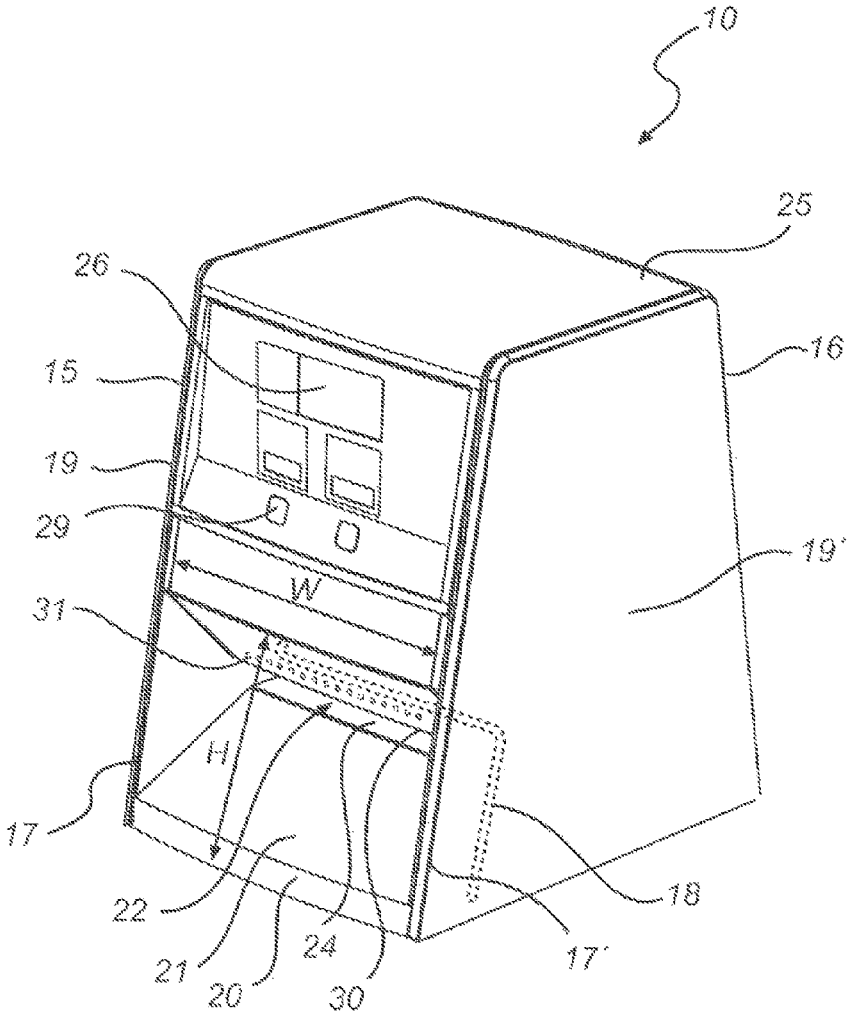
FIGS. 3*a-b* shows an embodiment of an electronics module.

In FIG. 3*a* a first embodiment of the electronics module 10 is shown. The electronics module 10 comprises channel means 14 extending from a first side 15 to a second side 16 of the electronics module 10. The channel means 14 are formed by supporting members 17 and 17' that in the exemplary first embodiment are sidewalls 19 and 19' of the electronics module 10. The channel means 14 is supported by a structure 20 that forms a cover surface of a ventilation channel formed by the channel means 14. Thereby, a through opening 22 extending between the first side 15 and the second side 16 is formed. The through opening 22 has a width w and allows air to pass from the first side 15 to the second side 16 or vice versa. A plurality of conductors 18 are arranged vertically along one side wall 19 of the channel means 14.

The structure 20 has an upper surface 21, i.e. the cover surface for the ventilation channel, having a middle portion 24 that is substantially parallel to the horizontal plane. The structure 20 has a double ramp shape. The direction of inclinations of the ramp is in a direction along which the ventilation channel extends. When arranged in the electronics module 10, the structure 20 is inclined upwardly in a direction from the first side 15 of the electronics module 10 towards the middle portion 24. The structure 20 is inclined downwardly from the middle portion 24 in a direction towards the second side 16.

There are several possible variations of how the structure may support the electronics module 10. For instance, the structure 20 can be assembled between the sidewalls 19, 19'. Another possibility is that the structure 20 and the side walls 19, 19' can be cast in one piece. Alternatively, the structure 20 can have two openings (not shown) for receiving the side walls 19, 19'. Of course, other variations of how to support the channel means 14 are also possible, which a skilled person would readily understand.

Beneficially, the ramp shape of the structure 20 provides an increased air flow speed through the through opening 22. Hence, fuel vapors around the connectors 18 may be vented more efficiently, further reducing any risk of explosion and thus providing a safer fuel dispensing unit.

Figure 4:
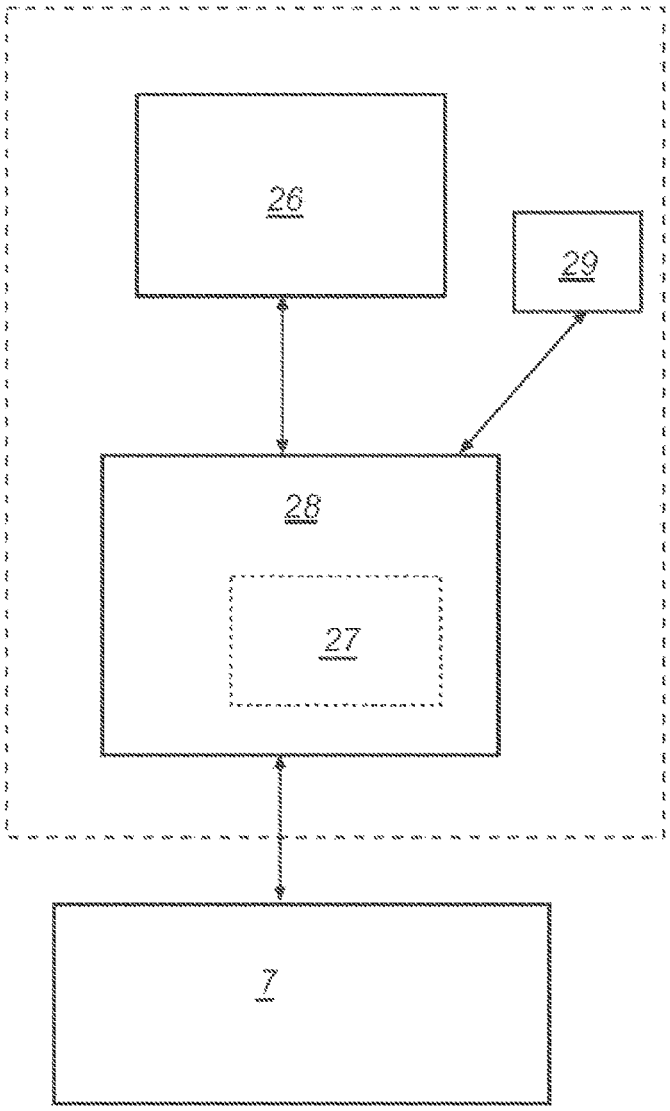
FIG. 4 shows a block diagram of the electronics module.

The electronics module 10 also has a housing 25 which comprises, among other things, a display 26 that presents a user interface for controlling the hydraulics 38 of the fuel dispensing unit 6*a-c*, and electronic circuitry 28. The user interface can be controlled by e.g. a processor 27 forming part of electronic circuitry 28 shown in FIG. 4. User interaction via the user interface can be provided by means of e.g. a keypad 29. Alternative, a touch-sensitive display could be utilized for user interaction.

The conductors 18 extend vertically along the side wall 19 to a height H corresponding to substantially the vertical level of a top surface 30 of the through opening 22. Here, the conductors 18 change direction to extend substantially horizontally along the top surface 30. The conductors 18 can extend across the channel along its width w. Alternatively, the conductors can extend horizontally across the top surface 30 from the first side 15 towards the second side 16 or vice versa. In both variations, the top surface 30 supports the conductors 18, the conductors 18 being guided along the top surface 30 in the interior of the housing 25.

The conductors 18 preferably run at least 20 cm along the horizontal direction of the top surface 30 to provide sufficient venting of the conductors 18.

In order to allow venting of the conductors 18 as they extend along the top surface 30, the top surface 30 comprises a plurality of perforations 31, thereby allowing airflow across the conductors 18. The perforations 31 may be evenly distributed along the top surface 30 to provide venting along the distance the conductors 18 extend horizontally.

Figure 3B:
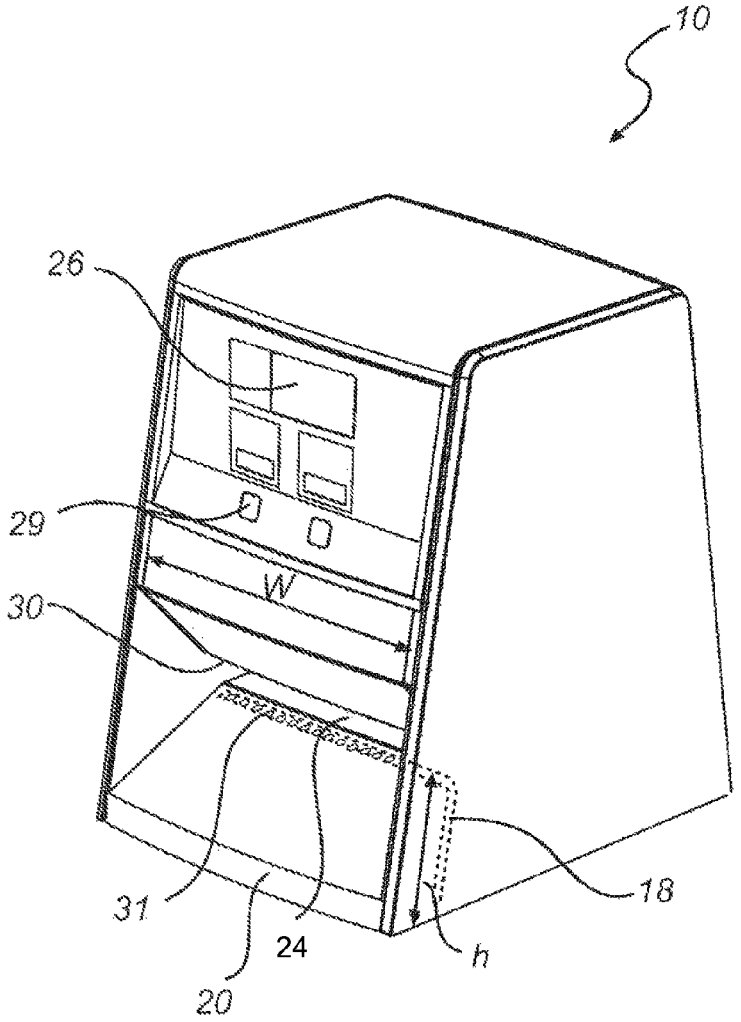

Alternatively, as shown in FIG. 3*b*, the conductors 18 extend vertically to a height h along the side wall 19, from where they change direction and extend in a horizontally along a bottom surface of the through opening 22, i.e. the upper surface 21 of structure 20. The conductors 18 can extend horizontally across the through opening 22 along the width w of the channel. Alternatively, the conductors can extend horizontally across the upper surface 21 of the structure from the first side 15 towards the second side 16 or vice versa. Also in this variation, the perforations are arranged such that the conductors 18 receive airflow along their horizontal extension.

In both variations, the upper surface 21 of the structure 20 supports the conductors 18. The conductors 18 can be guided along the upper surface 21 in an interior of the structure 20.

In order to allow venting of the conductors 18 as they extend along the upper surface 21, the upper surface 21 can comprise a plurality of perforations 31, thereby allowing airflow across the conductors 18.

By allowing air to flow across the conductors 18, fuel vapors can be vented from the connectors 18 before reaching the electronic circuitry 28 in the interior of the electronics module 10.

In a variation (not shown), the conductors 18 can be arrange outside of the housing 25 along the top surface 30 or upper surface 21 wherein the conductors 18 are passed through the housing 25 into the interior of the electronics module 10 via a perforation 31.

Figure 5B:
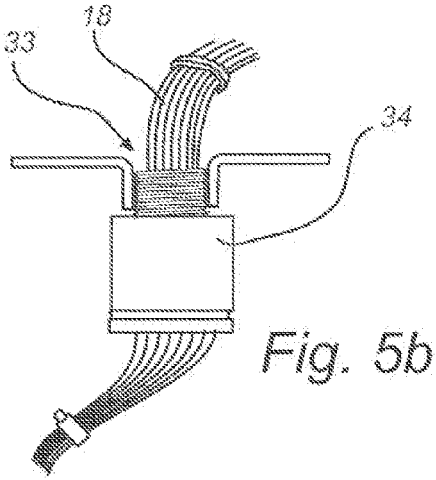
FIGS. 5*a-c* are perspective views of a part of a fuel dispensing unit shown in FIG. 2*a*.
Figure 5A:
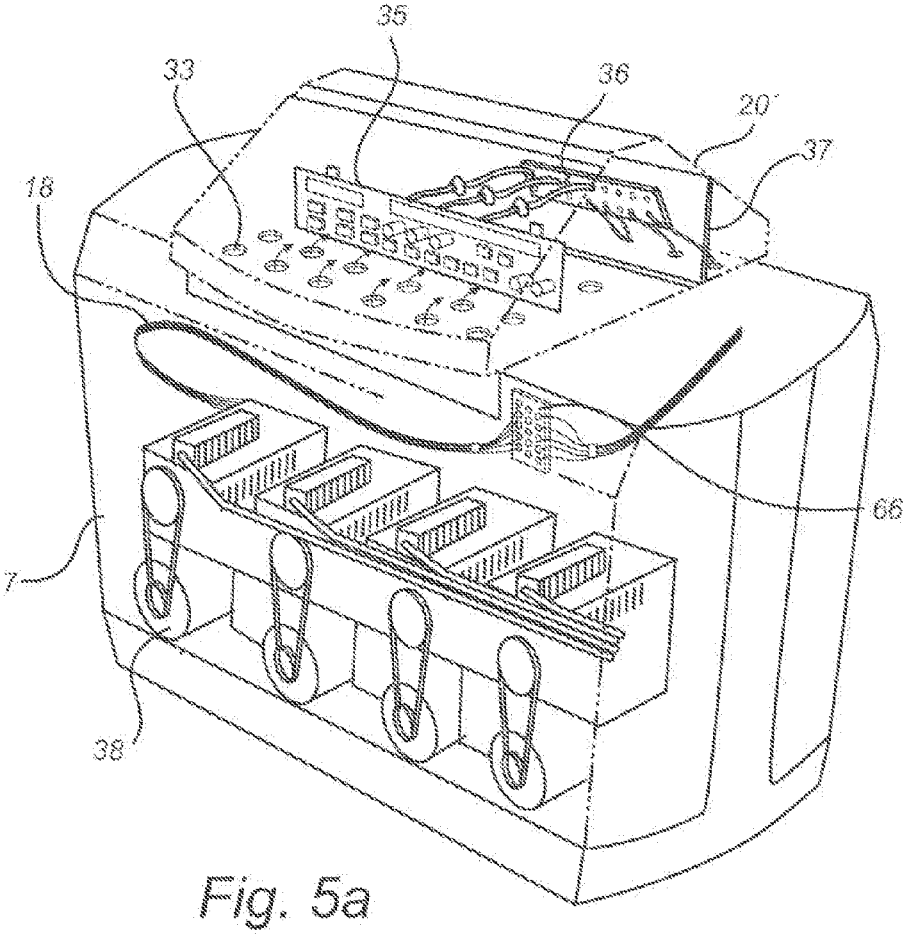

FIG. 5*a* shows a perspective view of part of a fuel dispensing unit 6*a* having a structure 20' having a sealing function towards the base module 7.

A top surface 32 of the base module 7 comprises a plurality of conductor openings 33. For each opening a gas tight coupling 34 provides an interface between the first safety zone Z1 and the second safety zone Z2. Alternatively a plastic cement mould may be provided around each conductor 18 at their respective conductor openings 33. Conductors 18 can thereby be coupled from the first safety zone Z1 to the second safety zone Z2 via a respective gas tight coupling 34 as shown in FIG. 5*b*. Structure 20' houses i.e. a first circuit board 35, a second circuit board 36 and a dividing wall 37. Typically, the hydraulics 38 is controlled by the first circuit board 35, wherein electronic circuitry 28 may be powered by the second circuit board 36. Data communication with the electronic circuitry may also be provided by the second circuit board 36. The first and the second circuit boards 35 and 36 may be connected as shown in FIG. 5*a*.

Additional control of the hydraulics 38 in the base module 7 may be provided by intrinsically safe circuit board 66, which may for instance be an EEXI board. The intrinsically safe circuit board 66 may typically be utilized only for low voltage signaling in order to minimize the risk of formation of sparks in the electronic circuitry on the circuit board 66. If the intrinsically safe circuit board 66 is arranged in the base module 7 as shown in FIG. 5*a*, it may, in order to increase the security even further, be sealed from the hazardous environment in the base module 7 e.g. by encapsulation.

Figure 5C:
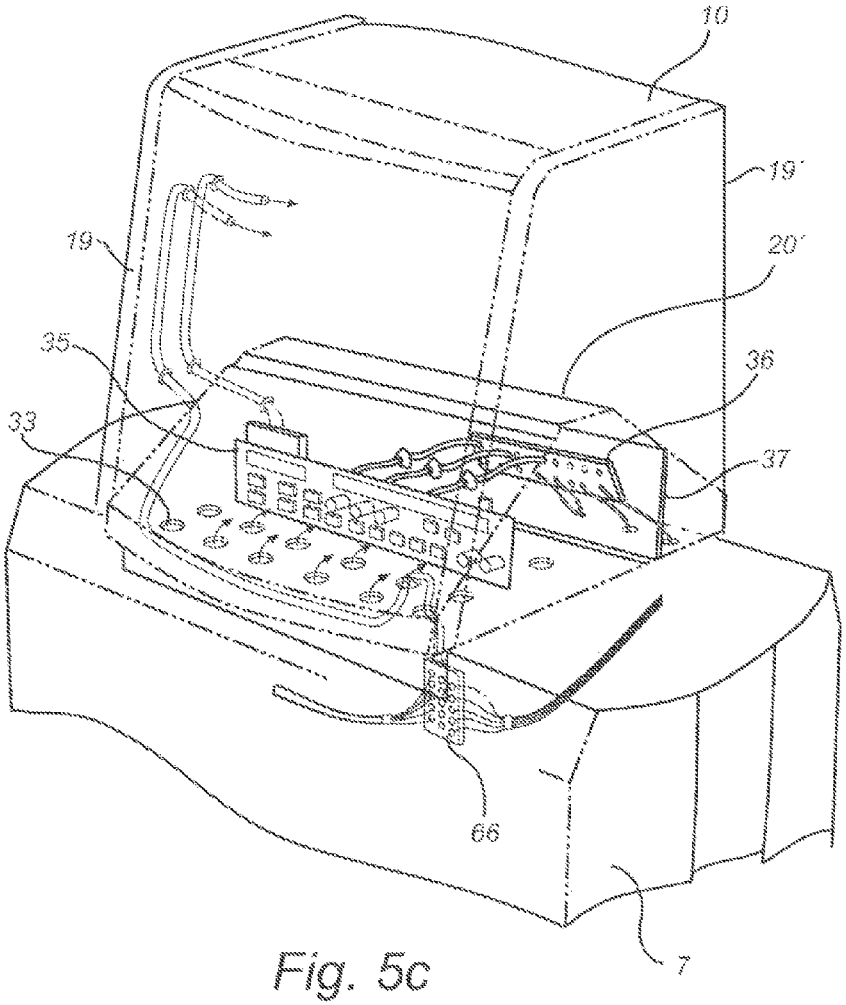

Generally, conductors 18 can be relayed from the first circuit board 35, via side wall 19 to the electronic circuitry 28 that controls the user interface in the electronics module 10, as can be seen in FIG. 5*c*. Conductors 18 coupled to the intrinsically safe circuit board 39 may be relayed directly from the gas tight couplings 34 to the side wall 19.

Structure 20' is preferably divided into a first area A1 and a second area A2. The first area A1 may provide access to the first circuit board 35 by e.g. an operator authorized by for instance the fuel dispensing unit manufacturer as for safety reasons generally only highly skilled service personnel should access this area. The second area A1 may provide access to circuit board 36 by e.g. regular service personnel. The two areas A1 and A2 may be separated by the wall 37. The structure 20' can be hinged at the middle portion 24 providing independent interior access from both sides 15 and 16 to the first and the second circuit boards 35 and 36 respectively.

By providing a safety zone interface between the base module 7 and structure 20', perforations 31 as described in the first embodiment may not be needed for venting the conductors 18. That is, an electronics module 10 without the above-described venting of conductors 18 may be designed.

However, embodiments of the electronics module 10 combining the above described sealing design together with the venting perforations 31 as described with reference to the first embodiment are readily envisaged. Beneficially, by providing the easily accessible first and second circuit boards 35 and 36, connection of conductors 18 to the circuit boards 35 and 36 is generally the same, rendering it simple for the service person to connect the electronics module 10 to the base module 7. In addition, the second embodiment of the electronics module 10 provides a solution that may fulfill both the ATEX directive and UL standards for safety.

Figure 6A:
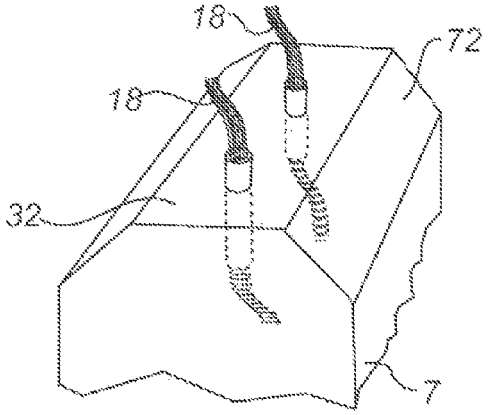
FIGS. 6*a-c* show schematic perspective views of a part of a fuel dispensing unit.

With reference to FIG. 6*a*, a perspective view of a portion of the base module 7 is shown. The top surface 32 of the base module 7 has slanting lateral portions 72. For simplicity, only two conductors 18 extending through the top surface 32 are shown. The conductors 18 can extend through the top surface by means of gas-tight couplings as described above to fulfill the UL standards. Alternatively, the conductors 18 may extend through the top surface 32 without any sealing between the first safety zone Z1 and the second safety zone Z2 thereby fulfilling the ATEX directive.

Figure 6B:
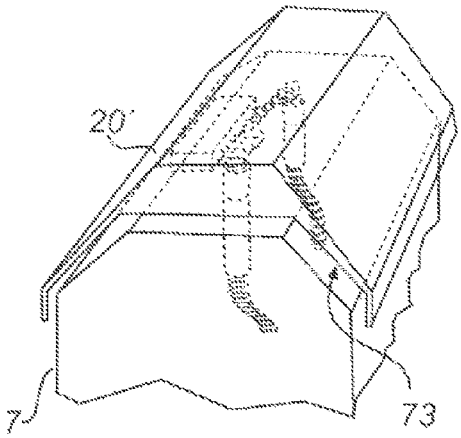

In FIG. 6*b*, the structure 20' is arranged on the top surface 32. An air gap 73 is formed between at least one of the slanting lateral portions 72 and one of the inclined ramp portions of the structure 20'. The air gap(s) 73 can for instance be formed by the slanting lateral portion(s) 72 having different inclination than the inclination of the inclined ramp portion(s) of the structure 20'. For instance, the inclination of the inclined ramp portion(s) may be greater than the inclination of the slanting lateral portions 72 with respect to the horizontal plane.

Alternatively, there may be distancing means provided between the slanting lateral portion(s) 72 and the inclined ramp portions. By distancing the slanting lateral portion(s) 72 from the structure 20', the air gap 73 may be formed therebetween. By using distancing means, the base module 7 need not have slanting lateral portions 72. The top surface 32 may for instance be substantially flat.

By providing the air gap 73 between the top surface 32 and the structure 20', a gas barrier is formed whereby it may not be necessary to utilize the gas-tight couplings between the base module 7 and the structure 20'. As an alternative however, a combination of the gas-tight coupling between the base module 7 and the structure 20' and the air gap solution is envisaged.

Figure 6C:
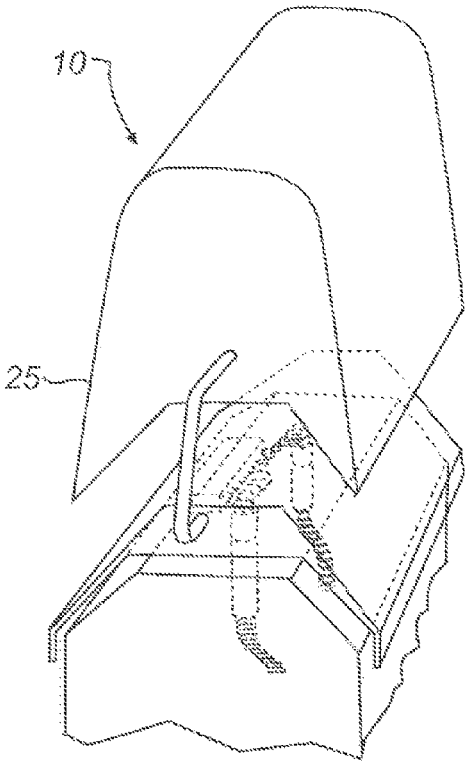

FIG. 6*c* is a schematic view of the housing 25 being arranged on the structure 20'. A lateral portion of the housing 25 may be embossed, i.e. comprise a "bulge", to provide space for the conductors 18 coupled between the first and second circuit boards 35 and 36 to the electronic circuitry 28 in the upper portion of the electronics module 10. Alternatively, at least one of the side walls 19, 19' may be embossed, depending on the design of the electronics module 10.

By providing an embossed housing 25 (or side wall(s) 19, 19'), the conductors 18 may be coupled to the electronic circuitry 28 without leaving the second safety zone Z2. Thus, the conductors 18 may be physically separated from hydraulics (in e.g. the nozzle module) after entering the second safety zone Z2 when leaving the base module 7 all the way to the electronic circuitry 28. Alternatively, an embossed cover plate (not shown) may be attached to the housing 25 in order to provide space for the conductors 18 between the cover plate and the housing 25.

Figure 7A:
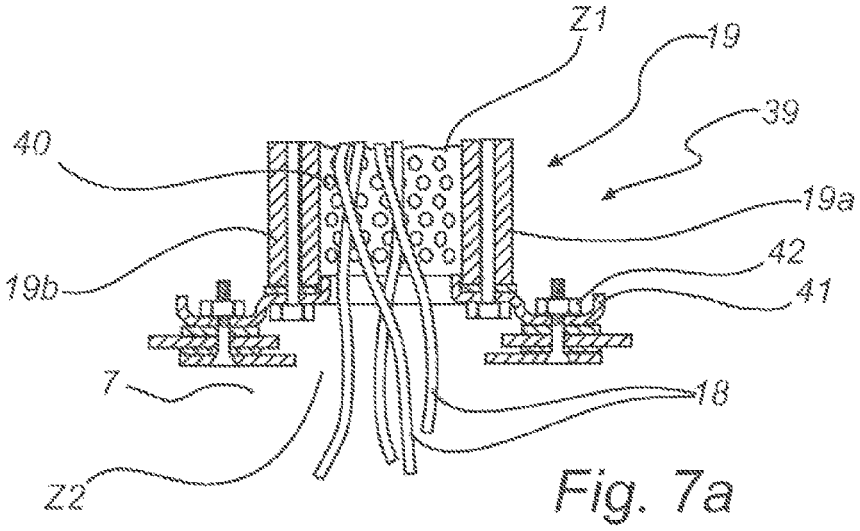
FIGS. 7*a-b* show cross-sectional views of a vapor reducing arrangement between a base module and the electronics module.
Figure 7B:
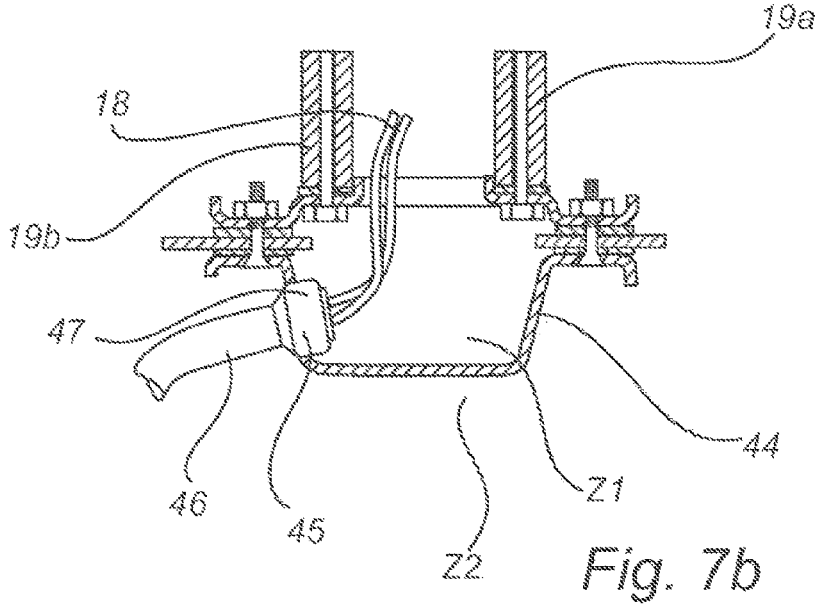

FIGS. 7*a* and 7*b* show various vapor reducing arrangements 39 for the connectors 18 when the electronics module 10 is arranged on the base module 7 of fuel dispensing unit 6*a-c*. The vapor reducing arrangements 39 may be used in addition to the previously described venting design of the first embodiment and/or the sealing design of the second embodiment of the electronics module 10 to provide additional safety to a fuel dispensing unit. Alternatively, the vapor reducing arrangements 39 may be utilized in an electronics module 10 that has no venting design or sealing design features as those previously described herein.

FIG. 7*a* is a cross-section of a part of side wall 19 and base module 7, when the side wall 19 and the base module 7 are assembled together. The side wall 19 in turn is assembled from two side plates 19*a* and 19*b*, wherein the interior defined between the two side plates 19*a* and 19*b* is filled with a vapor sealing substance 40 such as a fire rated expandable foam. The base module 7 defines a first safety zone Z1 and the interior of the side wall 19 defines a second safety zone Z2. To prevent leakage of fuel vapors from the base module 7, an interface between the side plates 19*a* and 19*b* and the base module 7 is formed by a packing arrangement 41 that is fastened between the side plates 19*a* and 19*b* and the base module 7 by fasteners 42. Conductors 18 can by the arrangement 40 be guided straight from the base module 7 to the interior of side wall 19. An effect achieved by the arrangement 40 on its own is that the ATEX directive may be fulfilled.

FIG. 7*b* shows an alternative assembly of side wall 19 with base module 7. The base module defines the first safety zone Z1 and the interior of side wall 19 defines the second safety zone Z2. The side plates 19*a* and 19*b* are sealed towards the base module 7 by means of packing arrangement 43. Fasteners 42 fasten the side plates 19*a* and 19*b* to the top surface 32 of base module 7. In the variation shown in FIG. 6*b*, a dividing seal 44 is arranged between side wall 19 and the interior of base module 7. The dividing seal 44 has an opening 45 that can receive a cable 46 comprising the conductors 18. The opening 45 provides an interface between the two zones Z1 and Z2. The cable 46 can be fixed to the opening 45 by a gas-tight coupling 47. On the second safety zone Z2 side of the dividing seal 44, the conductors 18 are led through the interior of side wall 19.

Figure 8A:
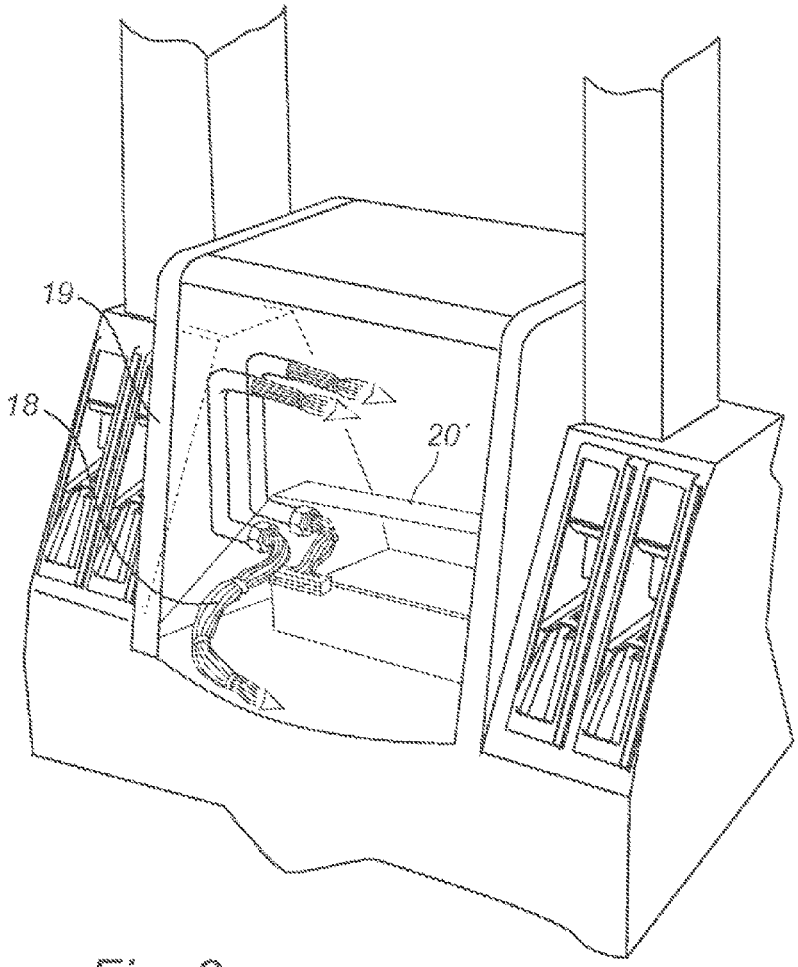
FIGS. 8*a-b* show perspective views of a vapor reducing arrangement between a base module and the electronics module.
Figure 8B:
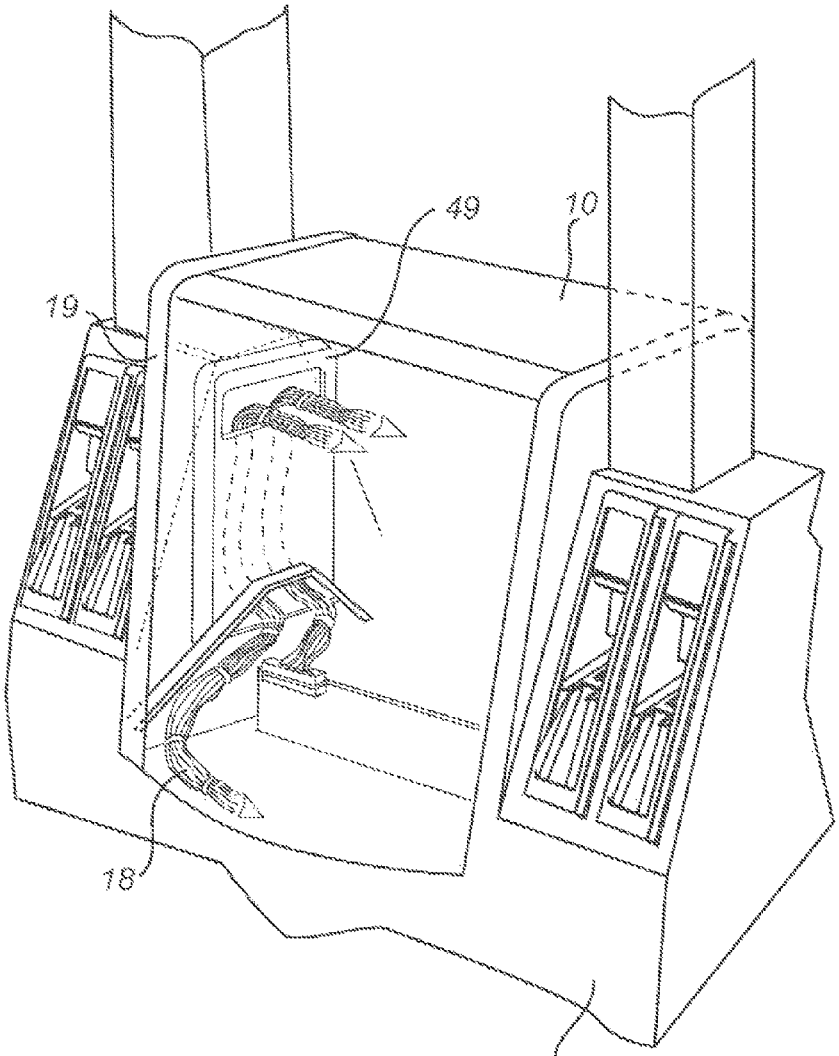

In FIGS. 8*a-c* several variations are shown on the above-described wall sealing methods in connection with structure 20'. More specifically, in FIG. 8*a*, conductor coupling through side wall 19 is shown wherein a gas-tight coupling 48 is provided as an interface between the interior of the structure 20' and side wall 19. In FIG. 8*b*, vertical coupling of conductors 18 is provided in a conductor channel 49 adjacent the side wall 19. This design may beneficially fulfill the provisions set forth in the UL standards. In FIG. 8*c*, the conductors are relayed through the side wall 19 to the electronic circuitry 28.

Figure 9A:
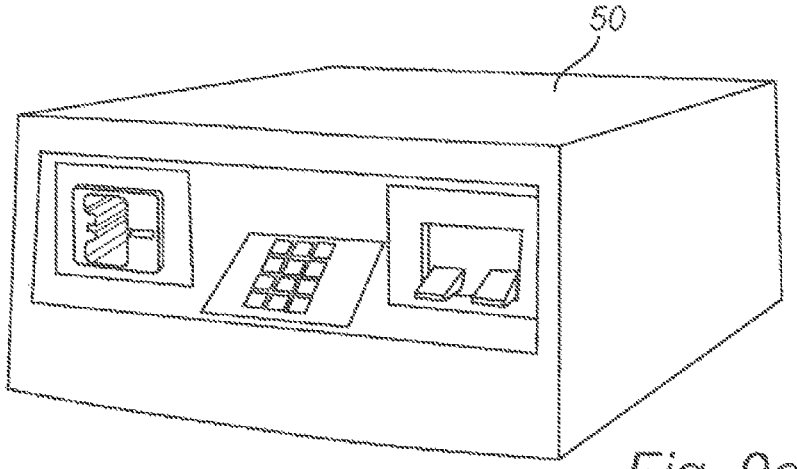
FIG. 9*a* shows a perspective view of a transaction module of the electronics module.
Figure 9B:
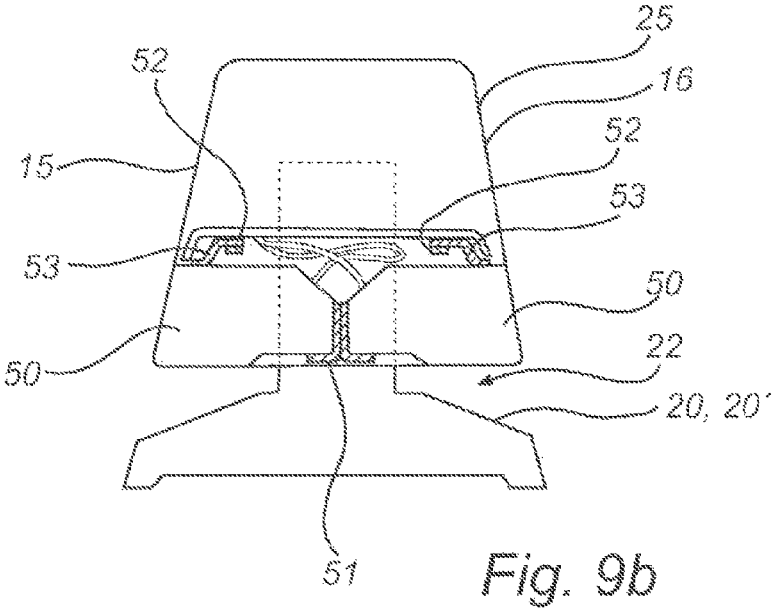
FIG. 9*b* shows a schematic cross-sectional side view of an electronics module comprising the transaction module of FIG. 9*a*.

FIGS. 9*a-b* shows a modular aspect of the electronics module 10. The electronics module 10 can be designed to provide a rack for mounting various electronic components in the housing 25. In the example shown in FIG. 9*a*, a transaction module 50 may be inserted into a rack of the electronics module 10. A more detailed view of an example of how to mount the transaction module 50 is illustrated in FIG. 9*b*, showing a lateral view of the electronics module 10, where the transaction module 50 is mounted above structure 20, 20'. As can be seen, the through opening 22 is below the transaction module 50. Supporting plates 51 in the interior of the housing 25 receives a bottom portion of the transaction module 50. Two transaction modules 50 are arranged in the electronics module 10, one to be used from each of the first and the second sides 15 and 16 respectively. Side walls 19 and 19' may be used for providing support to the supporting plates 51. To provide additional support to the transaction modules 50, hitches 52 are arranged in the housing 25 for receiving supporting structures 53 of the transaction modules 50. In use, the transaction modules 50 are coupled to the electric circuitry 28.

Figure 10:
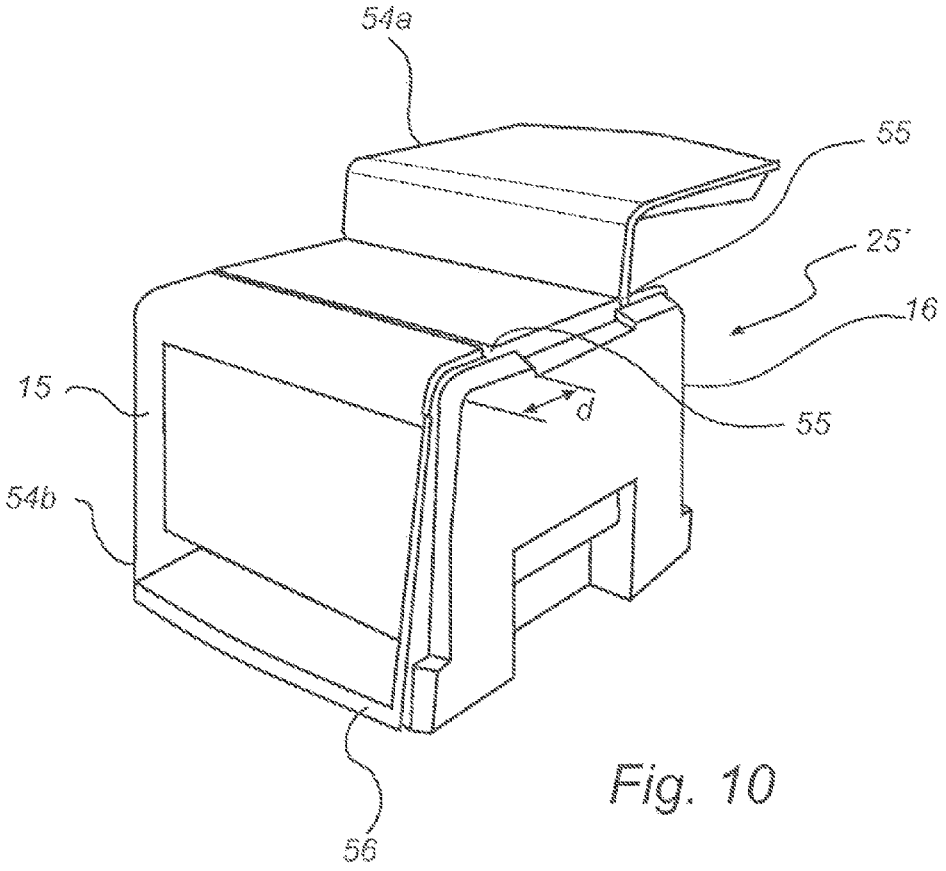
FIG. 10 shows a perspective view of an upper part of a housing of the electronics module.

FIG. 10 illustrates a service aspect of the electronics module 10.

An upper part 25' of housing 25 can have doors 54*a* and 54*b* that are pivotably arranged by pivoting means 55, such as for instance hinges. For the sake of simplicity, the side walls 19 and 19' are not shown in FIG. 10.

By pivoting the doors 54*a* and 54*b*, easy access can be provided to the interior electronic circuitry 28 of the electronics module 10. Each door 54*a-b* may have a frame 56, whereby the display 26 can be located, at least when a door 54*a*, 54*b* is in its closed state, such that a user can see the display 26 inside the frame 56.

From a closed state to an open state, the pivoting of the door 54*a*, 54*b* may preferably be made upwardly with respect to the horizontal plane. From an open state to a closed state, the pivoting of the door may be downwardly with respect to the horizontal plane.

In order to provide better access to the interior of the housing 25, an upper portion of the door 54*a*, 54*b* is curved inwardly towards the upper part 25' and transcends into a plane surface on top of the upper portion 25'. Hereto, the pivoting means 55 are arranged at a distance d inwardly from the first side 15 or the second side 16 (depending on the door 54*a* or 54*b*). Of course, the door need not be curved, but can for instance be bent inwards with respect to e.g. the first side 15. An angle with which it could be bent can be 0° to below 90° with respect to the horizontal plane.

Figure 11A:
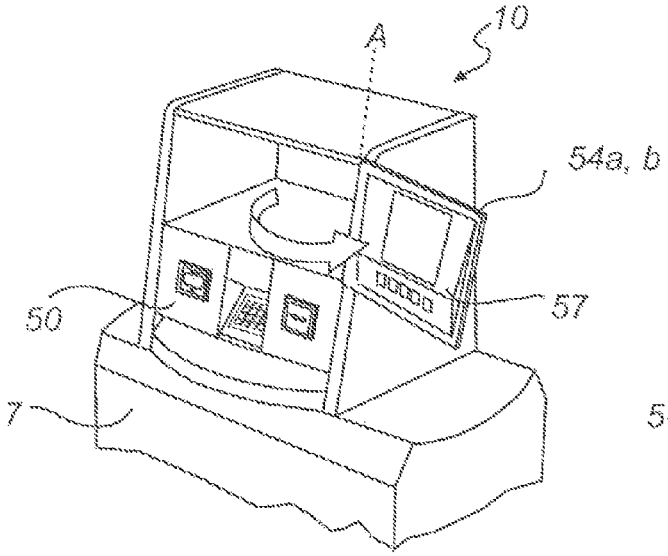
FIGS. 11 *a-c* show perspective views of the electronics module illustrating various service aspects thereof.

With reference to FIG. 11*a*, a variation of the door 54*a*, b described in FIG. 10 is shown. The door 54*a, b* is hinged on a side, wherein the door 54*a* can be opened and closed by turning it around a substantially vertical axis A. A door assembly 57, described in more detail below, is mounted on an interior side of the door 54*a, b* enabling easy access to the electronics of the door assembly 57 when the door 54*a, b* is in an open position.

Figure 11B:
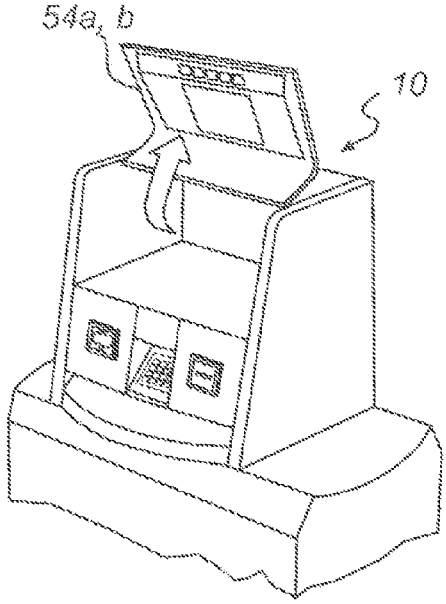

FIG. 11*b* show the pivotable door 54*a, b* described in FIG. 10 with the door assembly 57 being mounted in the door 54*a, b*.

Figure 11C:
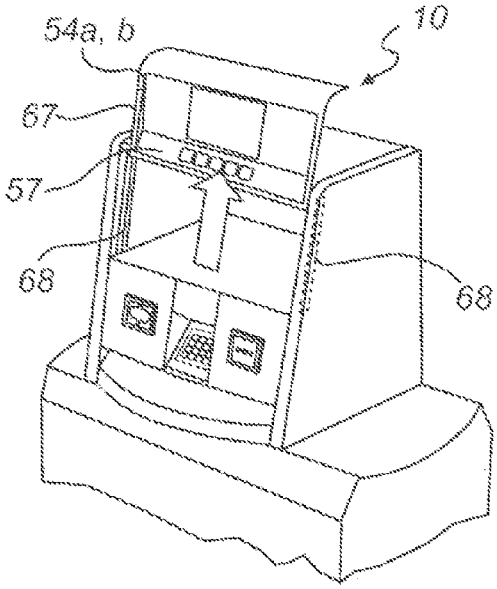

FIG. 11*c* shows another variation of the door 54*a, b*. In this variation, the door 54*a, b* is slidably arranged in the housing 25. More specifically, lateral portions 67 of the door 54*a, b* run in grooves 68 of the housing 25. By sliding the door 54*a, b* along the groove 68, the interior of the electronics module 10 can be accessed, enabling e.g. a service person to perform service operations on the electronic circuitry 28 and/or the door assembly 57.

Figure 12A:
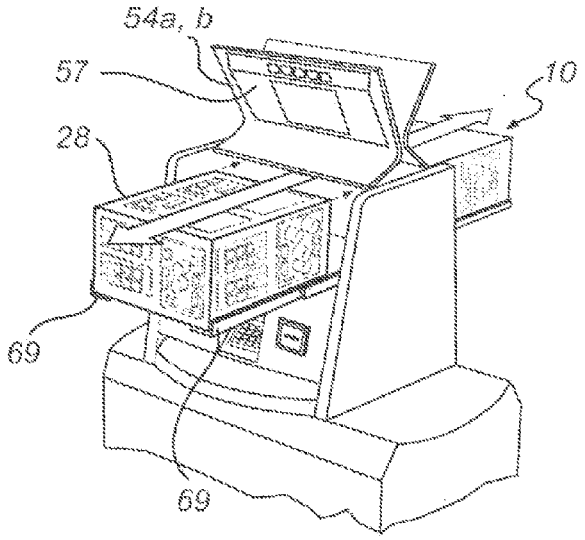
FIGS. 12*a-c* show perspective views of the electronics module illustrating various service aspects thereof.
Figure 12B:
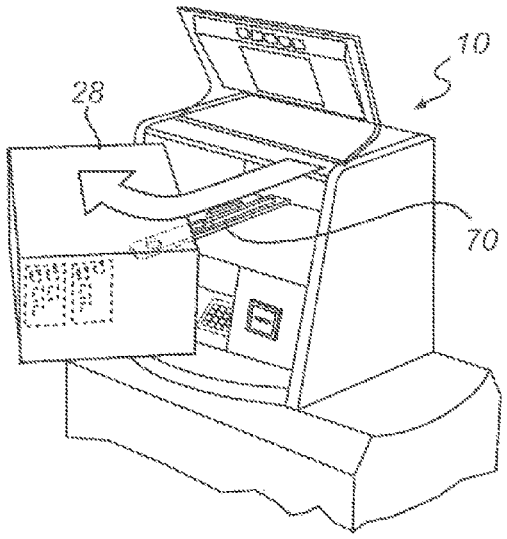
Figure 12C:
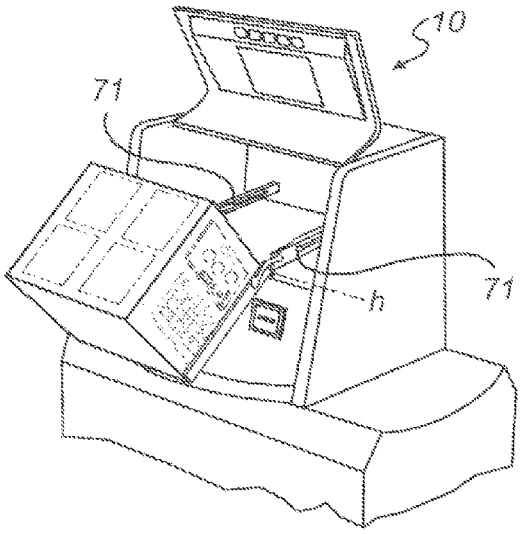

FIGS. 12*a-c* show arrangements of how to assemble the electronic circuitry 28 in the housing 25 so that it can be removed e.g. for service operations.

With reference to FIG. 12*a*, the electronic circuitry 28 is slidably arranged on rails 69 mounted in the interior of the housing 25. By opening the door 54*a, b*, the electronic circuitry 28 can be removed upon sliding the electronic circuitry 28 outwardly from the housing 25 along the rails 69. Thus, the electronic circuitry 28 can be removed from its operational position to a service position. Thereby, the electronic circuitry 28 is set free from the protective housing 25 enabling for instance service operations. Any side of the electronic circuitry 28 may beneficially be accessed when in its service position.

Additionally, the rails 69 may be arranged such that the electronic circuitry may be slidably displaced into its service position from both the first side 15 and the second side 16, depending on which door 54*a* and 54*b* maintenance personnel selects to access the electronic circuitry 28. Thus, the electronic circuitry 28 may be slidably displaced by means of the rails 69 in opposite directions.

FIG. 12*b* shows an alternative to the variation shown in FIG. 12*a*. More specifically, the electronic circuitry 28 can be placed on a rail 70 that allow the electronic circuitry 28 to be slid out of the housing 25. Further, the rail 70 can be provided with a turning means (such as for instance a screw or shaft, with or without bearings depending on the weight of the electronic circuitry 28) that enables rotation of the electronic circuitry 28. Advantageously, by rotating the electronic circuitry 28 around the turning means when in its service position, access may be provided to a far end side of the electronic circuitry 28 with respect to the door 54*a, b*.

In FIG. 12*c*, another alternative for accessing the electronic circuitry 28 is illustrated. The electronic circuitry 28 can be slid along rails 71 when pulled out from the housing 25. The electronic circuitry 28 can thereafter be tilted around horizontal axis H into a service position. Thereby any side of the electronic circuitry 28 may be accessed for service operations.

Figure 13:
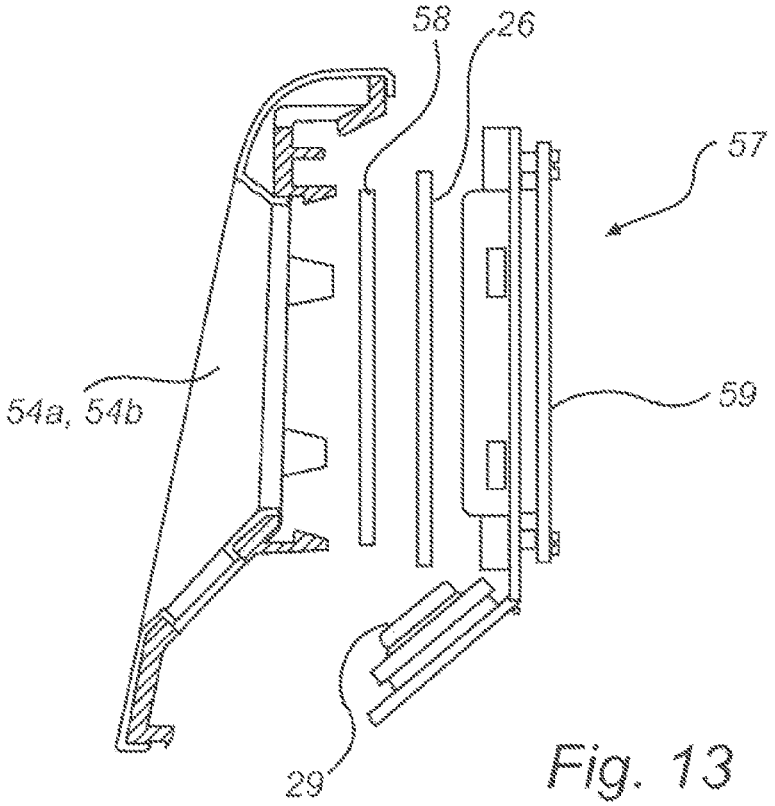
FIG. 13 shows an exploded view from the side of a door arrangement of the door of the upper part of the housing shown in FIG. 10.

FIG. 13 shows a detailed side view of the door assembly 57 shown in FIGS. 12*a-c*, comprising the door 54*a*, 54*b*, a window 58 that can be snapped into place in the door 54*a*, 54*b*, and a display arrangement 59 comprising the display 26, which can for instance be an LCD display, TFT display or OLED display, and keys 29. The components 58 and 59 can all be snapped into place in the door 54*a* and 54*b*. The display arrangement 59 may be coupled to processor 27 that can be distinct for both doors 54*a* and 54*b*. Alternatively, a single processor 27 may control the display arrangements 59 for both doors 54*a* and 54*b*.

Figure 14:
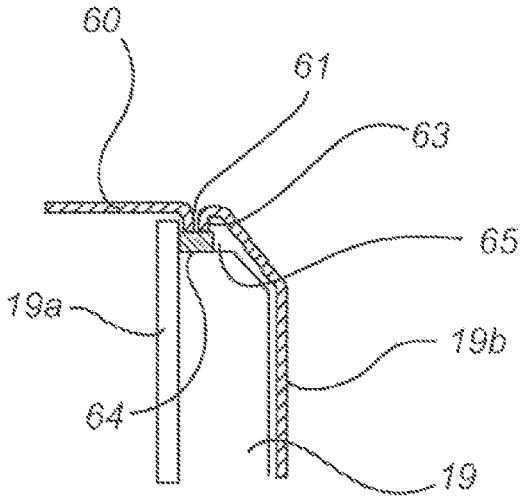
FIG. 14 shows a partial cross-section of the upper part of the housing shown in FIG. 10.

With reference to FIG. 14, a partial cross-sectional view of the upper right corner is shown, where in addition to what is shown in FIG. 10, side wall 19 is mounted on the electronics module 10. An upper surface 60 of the upper portion 25' has a protruding part 61 that is bent downwardly with respect to horizontal plane. Side plate 19*a* of side wall 19 extends to a vertical level above a lowest part 62 of the protruding part 61. Further, the side plate 19*a* is arranged below the upper surface 60 before the protruding part 61 is bent downwardly. Thereby, the protruding part 61 overlaps side plate 19*a*, providing to seal out the environment from the side wall 19, e.g. protecting the electronics module 10 from precipitation. In addition, the outer side plate 19*b* have an angular disposition towards the upper surface 60 and an end portion 63 thereof can also be bent downwardly with respect to horizontal plane. In a variation of the described arrangement between the side wall 19 and the upper surface 60, a gasket 64 such as an emi gasket can be placed between an interior surface 65 of the side wall 19 and between the downwardly facing end portion 63 and the protruding part 61.

Other variations of the inventive concept may be possible within the scope of the appended claims. For instance a transverse cross-section of the ventilation channel may be rounded or of any other suitable shape. Further, the opening need not be below the electronic circuitry, but may be on a side thereof. Thus, the conductors may be led along a vertical section of the electronics module along what would be the base of the structure 20, 20' of the above described embodiments, which in this case would be arranged vertically instead of horizontally. Then the conductors would be led horizontally to the electronic circuitry 28 via a side wall 19 that would be arranged horizontally.

While the inventive concept has been illustrated and described in detail in the drawings and foregoing description, such illustration and description are to be considered illustrative or exemplary and not restrictive; the inventive concept is not limited to the disclosed embodiments. Other variations to the disclosed embodiments can be understood and effected by those skilled in the art in practicing the claimed inventive concept, from a study of the drawings, the disclosure, and the appended claims. The mere fact that certain measures are recited in mutually different dependent claims does not indicate that a combination of these measures cannot be used to advantage.

Furthermore, any reference signs in the claims should not be construed as limiting the scope.

The invention claimed is:

1. An electronics module for use in a fuel dispensing unit, the fuel dispensing unit having a base module containing hydraulics, the electronics module comprising:

electronic circuitry for controlling the hydraulics of the fuel dispensing unit, a conductor for connecting the electronic circuitry to the hydraulics of the fuel dispensing unit, and a housing having a first side, a second side, and sidewalls forming a structure that is configured to reside on top of a base module, the structure defining a through opening extending from the first side to the second side of the housing, the through opening configured to allow air to pass through the housing, the structure having a double ramp shape with a surface inclining upwardly from the first side of the housing to a middle portion and inclining downwardly from the middle portion to the second side of the housing, the conductor extending horizontally through the double ramp shape, wherein the structure has at least one perforation arranged to allow venting of the double ramp shape and the conductor disposed therein.

2. The electronics module of claim 1, wherein the second side is opposite the first side.

3. The electronics module of claim 1, wherein the conductor is arranged along a vertical direction proximate at least one of the sidewalls.

4. The electronics module of claim 3, wherein the conductor is arranged in a horizontal direction along the through opening.

5. The electronics module of claim 1, wherein the structure is arranged below the electronic circuitry.

6. The electronics module of claim 1, wherein the structure further comprises spaced apart supporting members disposed on the sidewalls of the housing.

7. The electronics module of claim 1, further comprising at least one conductor channel adjacent to one of the sidewalls to receive the conductor therein.

8. The fuel dispenser of claim 1, wherein the conductor extends horizontally below the through opening.

9. The fuel dispenser of claim 1, wherein the at least one perforation is below the through opening.

10. A fuel dispenser, comprising:

an electronics module comprising a housing having a first side, a second side, and sidewalls forming a structure having a double ramp shape with a surface inclining upwardly from the first side of the housing to a middle portion and inclining downwardly from the middle portion to the second side of the housing, and a conductor coupling electronic circuitry in the electronics module to hydraulics in a base module of the fuel dispenser, the conductor located on an interior of the double ramp shape, wherein the structure defines a through opening that extends from the first side to the second side of the housing to allow air to pass through the housing, and wherein the structure comprises a plurality of perforations disposed in the double ramp shape proximate the through opening to allow venting of the double ramp shape and the conductor disposed therein.

11. The fuel dispenser of claim 10, wherein the conductor extends horizontally above the through opening.

12. The fuel dispenser of claim 10, wherein the conductor extends vertically along one of the sidewalls.

13. The fuel dispenser of claim 10, wherein the plurality of perforations are above the through opening.

14. The fuel dispenser of claim 10, further comprising a nozzle module connected to the base module and adapted to hold at least one nozzle.

15. The fuel dispenser of claim 14, wherein the nozzle module is arranged adjacent to the electronics module.

16. A fuel dispenser, comprising:

a base module of the fuel dispenser;

a housing disposed above the base module, the housing having a first side, a second side, and a through opening extending between the first side and the second side that is configured to allow air to pass through the housing, the housing further comprising a structure having a double ramp shape with a surface that inclines upwardly from a first side to a middle portion and inclines downwardly from the middle portion to a second side of the housing;

a conductor on an interior of the housing, the conductor extending horizontal to the through opening and vertical to at least one sidewall of the housing, wherein the structure has a plurality of perforations arranged proximate the through opening to allow venting of the conductor.

17. The fuel dispenser of claim 16, wherein the conductor is disposed proximate the middle portion.

18. The fuel dispenser of claim 17, wherein the conductor is disposed above the through opening.

19. The fuel dispenser of claim 17, wherein the conductor is disposed below the through opening.

* * * * *